US008434787B2

(12) United States Patent
Halepatali et al.

(10) Patent No.: US 8,434,787 B2
(45) Date of Patent: May 7, 2013

(54) COUNTERWEIGHT ATTACHMENT AND REMOVAL SYSTEM AND MACHINE USING SAME

(75) Inventors: Praveen Halepatali, Tamil Nadu (IN); Ha-Rok Bae, Savoy, IL (US); Kazushige Okamoto, Kobi (JP); Hiroaki Ando, Champaign, IL (US); Yozo Nakamoto, Hyogo (JP); Chris Ha, Champaign, IL (US)

(73) Assignee: Caterpillar Inc., Peoria, IL (US)

( * ) Notice: Subject to any disclaimer, the term of this patent is extended or adjusted under 35 U.S.C. 154(b) by 157 days.

(21) Appl. No.: 13/157,609

(22) Filed: Jun. 10, 2011

(65) Prior Publication Data

US 2012/0315121 A1 Dec. 13, 2012

(51) Int. Cl.
*B60S 9/00* (2006.01)
*B66C 23/72* (2006.01)

(52) U.S. Cl.
USPC ..... 280/759; 212/178

(58) Field of Classification Search ..... 280/755, 280/757–760; 212/178, 195, 196; 414/719, 414/673; 172/611
See application file for complete search history.

(56) References Cited

U.S. PATENT DOCUMENTS

| | | | | |
|---|---|---|---|---|
| 2,325,089 | A | 7/1943 | Zeilman | |
| 3,375,021 | A | 3/1968 | Grider | |
| 3,533,524 | A | 10/1970 | Wilcox | |
| 3,902,735 | A | 9/1975 | Bertram et al. | |
| 3,924,753 | A | 12/1975 | Lamer et al. | |
| 5,141,195 | A | 8/1992 | Toda et al. | |
| 5,156,215 | A | 10/1992 | Jensen | |
| 5,332,353 | A * | 7/1994 | Arnold | 414/723 |
| 5,615,784 | A | 4/1997 | Pech et al. | |
| 5,833,268 | A | 11/1998 | Aldrovandi | |
| 6,050,430 | A | 4/2000 | Fleagle et al. | |
| 6,988,560 | B2 * | 1/2006 | Bay | 172/272 |
| 7,354,066 | B2 * | 4/2008 | Yamamoto | 280/759 |
| 7,618,062 | B2 * | 11/2009 | Hamm et al. | 280/759 |
| 7,658,293 | B2 * | 2/2010 | Yamamoto et al. | 212/178 |
| 7,669,898 | B2 | 3/2010 | Hamaguchi et al. | |
| 7,896,178 | B2 * | 3/2011 | Davis | 212/178 |

FOREIGN PATENT DOCUMENTS

| | | |
|---|---|---|
| JP | 08-319637 | 12/1996 |
| JP | 08-333776 | 12/1996 |
| JP | 200291070 | 10/2000 |
| JP | 2001310895 | 11/2001 |

* cited by examiner

*Primary Examiner* — Drew Brown
(74) *Attorney, Agent, or Firm* — Leydig, Voit & Mayer

(57) ABSTRACT

A counterweight attachment and removal system includes a machine mounting bracket and a link having two spaced apart arms. A proximal end of the link is pivotably coupled with the machine mounting bracket. A rotate cylinder has a proximal end pivotably coupled with the machine mounting bracket and a distal end pivotably coupled with a distal end of the link. A slide cylinder has a proximal end pivotably coupled with the link and a distal end pivotably coupled with a lift pin. The lift pin is positioned through slots defined by the two spaced apart arms. The counterweight attachment and removal system includes a first configuration in which the link is pivoted away from the machine mounting bracket, the rotate cylinder is retracted, the slide cylinder is extended, and the lift pin is positioned through distal portions of the slots. According to a second configuration, the link is pivoted toward the machine mounting bracket, the rotate cylinder is extended, the slide cylinder is retracted, and the lift pin is positioned through proximal portions of the slots.

20 Claims, 6 Drawing Sheets

COUNTERWEIGHT ATTACHMENT AND REMOVAL SYSTEM AND MACHINE USING SAME

TECHNICAL FIELD

The present disclosure relates generally to a counterweight attachment and removal system, and more particularly to a counterweight attachment and removal system including a rotate cylinder for pivoting a lift pin and a slide cylinder for axially moving the lift pin.

BACKGROUND

Heavy duty machines, such as hydraulic excavators, loaders, and the like, frequently have a counterweight attached to the back end of the machine to counterbalance the weight of an implement or work tool mounted on the front end of the machine. The counterweight may vary from a few hundred pounds on small machines to several tons on larger machines, and enables the machines to lift heavier loads and increases the stability of the machine during operation. The weight of the counterweight adds significantly to the total weight of the machine and, as such, may prove problematic when transporting the machine. For example, it may be necessary to remove the counterweight from the machine and transport the counterweight separately from the machine to comply with regulations regarding vehicle loads.

U.S. Pat. No. 7,669,898 to Hamaguchi et al. teaches an apparatus for detaching and attaching a counterweight that includes two links and three cylinders. Specifically, a proximal end of a first link is pivotally supported by a machine frame. A distal end of the first link supports a proximal end of a second link and distal ends of two cylinders. Proximal ends of the two cylinders are attached to the machine frame. A third cylinder has a proximal end attached to the first link and a second end attached to a distal end of the second link. A counterweight moves between detached and attached positions by pivoting the first link using the first and second cylinders. The counterweight may be raised and lowered by pivoting the second link using the third cylinder. The Hamaguchi et al. solution may be overly complex by the need for three separate hydraulic cylinders and associated moving parts.

The present disclosure is directed toward one or more of the problems set forth above.

SUMMARY OF THE DISCLOSURE

In one aspect, a counterweight attachment and removal system includes a machine mounting bracket and a link having two spaced apart arms. A proximal end of the link is pivotably coupled with the machine mounting bracket. A rotate cylinder has a proximal end pivotably coupled with the machine mounting bracket and a distal end pivotably coupled with a distal end of the link. A slide cylinder has a proximal end pivotably coupled with the link and a distal end pivotably coupled with a lift pin. The lift pin is positioned through slots defined by the two spaced apart arms. The counterweight attachment and removal system includes a first configuration in which the link is pivoted away from the machine mounting bracket, the rotate cylinder is refracted, the slide cylinder is extended, and the lift pin is positioned through distal portions of the slots. According to a second configuration, the link is pivoted toward the machine mounting bracket, the rotate cylinder is extended, the slide cylinder is refracted, and the lift pin is positioned through proximal portions of the slots.

In another aspect, a method of operating a machine having a counterweight attachment and removal system includes loading a counterweight onto the machine by pivoting a link away from the machine and positioning a lift pin through distal portions of slots, wherein the slots are defined by two spaced apart arms of the link. Lift hooks of the counterweight are engaged with the lift pin. The link is then pivoted toward the machine, and the lift pin is moved from the distal portions of the slots to proximal portions of the slots.

In yet another aspect, a machine includes a frame and a pair of platforms supported on the frame. The machine also includes a counterweight attachment and removal system, which includes a machine mounting bracket supported on the frame and a link having two spaced apart arms. A proximal end of the link is pivotably coupled with the machine mounting bracket. A rotate cylinder has a proximal end pivotably coupled with the machine mounting bracket and a distal end pivotably coupled with a distal end of the link. A slide cylinder has a proximal end pivotably coupled with the link and a distal end pivotably coupled with a lift pin. The lift pin is positioned through slots defined by the two spaced apart arms. The counterweight attachment and removal system includes a first configuration in which the link is pivoted away from the machine, the rotate cylinder is retracted, the slide cylinder is extended, and the lift pin is positioned through distal portions of the slots. The counterweight attachment and removal system also includes a second configuration in which the link is pivoted toward the machine, the rotate cylinder is extended, the slide cylinder is refracted, and the lift pin is positioned through proximal portions of the slots.

DETAILED DESCRIPTION

Figure 1:
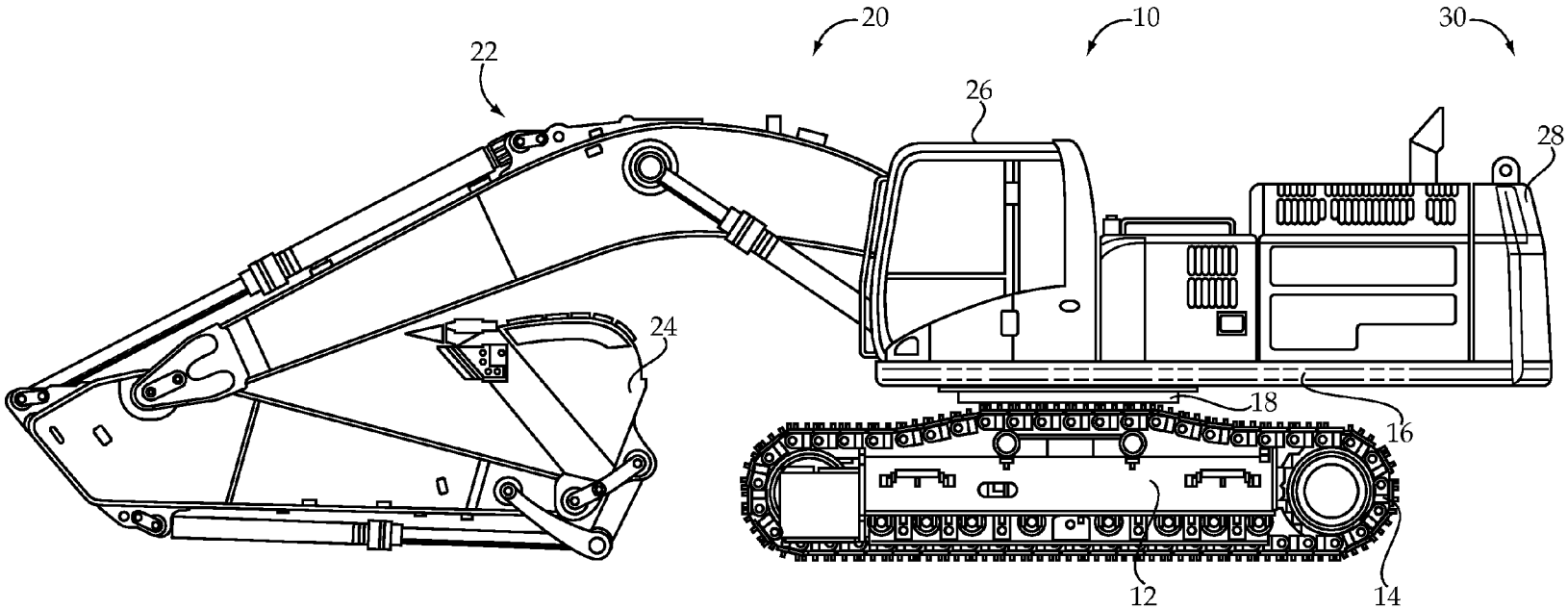
FIG. 1 is a side diagrammatic view of a machine, according to the present disclosure.

An exemplary embodiment of a machine 10 is shown generally in FIG. 1. The machine 10 may be a hydraulic excavator, as shown, or any other on-highway or off-highway vehicle used to perform work operations, such as, for example, a wheel loader, backhoe, or the like. In the illustrated embodiment, machine 10 includes a lower frame 12, or undercarriage, that includes ground-engaging elements, such as tracks 14, which may be provided at opposing sides of the lower frame 12. Although tracks 14 are shown, it should be appreciated that alternative ground-engaging elements, such as, for example, wheels, may be provided. An upper frame 16 is rotatably supported on the lower frame 12 through a rotation device 18. Upper frame 16 may support, at a front end 20 thereof, an implement system 22 configured to move a work tool 24 between work positions, and an operator control station 26 including common devices, such as, for example, machine operation controllers that facilitate operator control of various aspects of the machine 10. As shown in the illustrated embodiment, the machine 10 also supports a counterweight 28 at a back end 30 of the machine 10.

Figure 2:
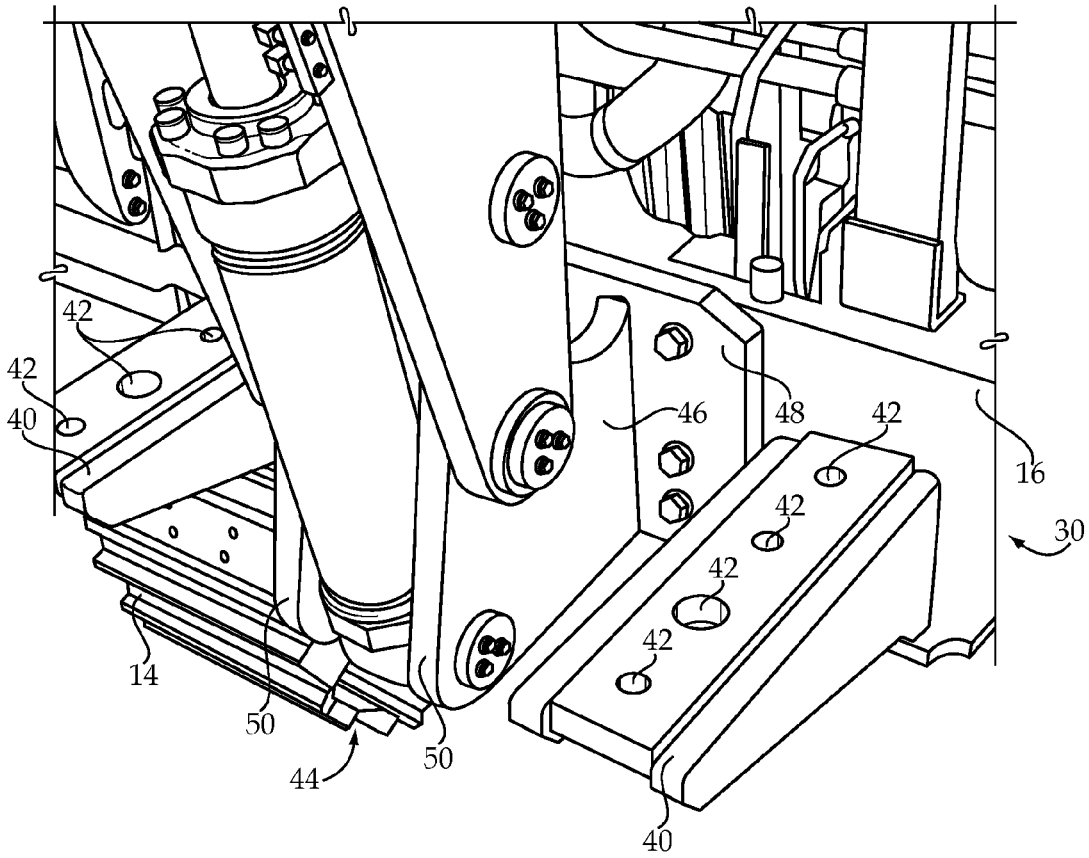
FIG. 2 is a perspective view of a back end of the machine of FIG. 1, with a counterweight removed to show a portion of a counterweight attachment and removal system, according to one aspect of the present disclosure.

The counterweight 28, as should be appreciated, may be attached to the back end 30 of the machine 10 to counterbalance the weight of the implement system 22 mounted on the front end 20 of the machine 10. As shown in FIG. 2, the back end 30 may include a pair of support platforms 40, which may be horizontally oriented, supported on the upper frame 16 that are sized and configured to support the counterweight 28 (not shown in FIG. 2). The pair of support platforms 40, according to the illustrated embodiment, may include one or more vertically aligned fastener bores 42 that are positioned to align with corresponding vertically aligned fastener bores of the counterweight 28 (shown in FIG. 8), when the counterweight 28 is attached to, or supported on, the machine 10. As should be appreciated, bolts or other fastener devices may be positioned through the pair of support platforms 40 to secure an attached position of the counterweight 28. A counterweight attachment and removal system 44, only a portion of which is shown in FIG. 2, includes a machine mounting bracket 46 that may be positioned between the pair of support platforms 40. The machine mounting bracket 46 may include a vertically oriented attachment plate 48 having a bolted connection to the upper frame 16, and two vertically aligned support plates 50 extending perpendicularly from the attachment plate 48 for supporting additional components of the counterweight attachment and removal system 44, as will be discussed below.

Figure 4:
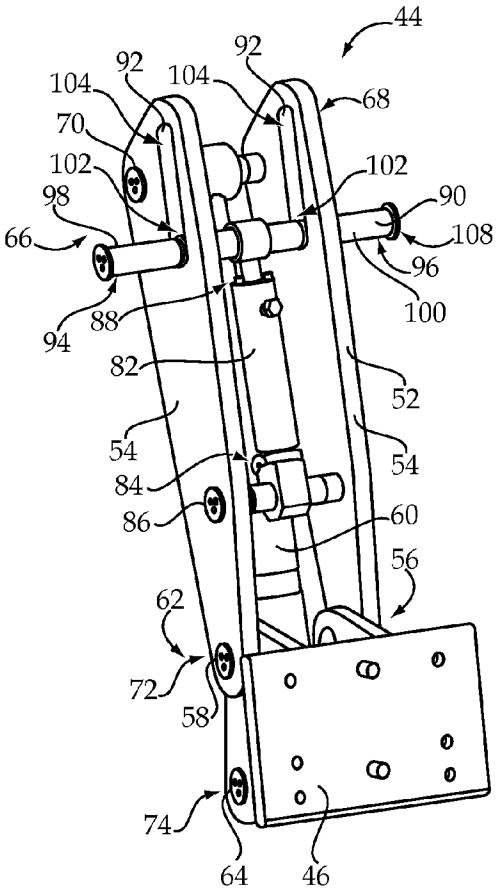
FIG. 4 is a perspective view facing a back end of the counterweight attachment and removal system of FIGS. 2 and 3, according to another aspect of the present disclosure.
Figure 3:
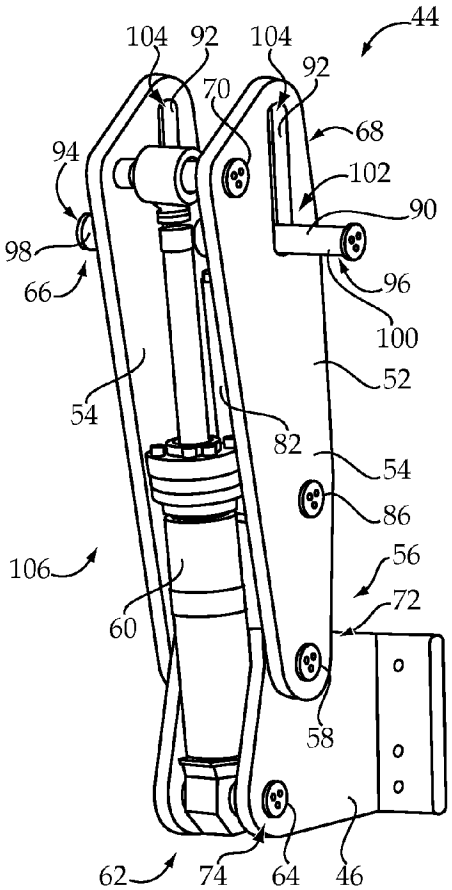
FIG. 3 is a perspective view facing a front end of the counterweight attachment and removal system of FIG. 2, according to another aspect of the present disclosure.

Turning now to FIGS. 3 and 4, an exemplary embodiment of the counterweight attachment and removal system 44 will be discussed in greater detail. As shown in the front facing view of FIG. 3 and the back facing view of FIG. 4, the counterweight attachment and removal system 44 generally includes a link 52 having two spaced apart arms 54, which may be substantially parallel. A proximal end 56 of the link 52 is pivotably coupled with the machine mounting bracket 46, using a support shaft 58 about which the arms 54 of the link 52 may rotate. The counterweight attachment and removal system 44 also includes a rotate cylinder 60 having a proximal end 62 pivotably coupled with the machine mounting bracket 46 at a support shaft 64 and a distal end 66 pivotably coupled with a distal end 68 of the link 52 using another support shaft 70. According to the illustrated embodiment, the proximal end 56 of the link 52 is pivotably coupled with the machine mounting bracket 46 at a first mounting location 72, while the proximal end 62 of the rotate cylinder 60 is pivotably coupled with the machine mounting bracket 46 at a second mounting location 74 that is lower relative to the machine mounting bracket 46 than the first mounting location 72.

As shown more clearly in FIG. 4, the counterweight attachment and removal system 44 also includes a slide cylinder 82 having a proximal end 84 pivotably coupled with the link 52 using a support shaft 86 and a distal end 88 pivotably coupled with a lift pin 90. The lift pin 90 is positioned through slots 92 defined by the arms 54, with opposing ends 94 and 96 of the lift pin 90 defining respective counterweight engagement surfaces 98 and 100. The slide cylinder 82, as will be described in greater detail below, is positioned to move the lift pin 90 between proximal portions 102 and distal portions 104 of the slots 92. As should be apparent from the various views provided herein, the counterweight attachment and removal system 44 has a front end 106, shown in FIG. 3, and a back end 108, shown in FIG. 4. The back end 108 of the counterweight attachment and removal system 44, with the machine mounting bracket 46 attached to the machine 16, as shown in FIG. 2, faces the back end 30 of the machine 10.

Preferably, the counterweight attachment and removal system 44 includes exactly two cylinders (i.e., the rotate cylinder 60 and the slide cylinder 82), as shown in the exemplary embodiment. Further, the two cylinders 60 and 82 are preferably positioned between two planes defined by the arms 54 of link 52. Each of the cylinders 60 and 82 may be hydraulic cylinders of conventional design including a tube portion and a piston portion arranged to form two separated pressure chambers. The pressure chambers may be selectively supplied with pressurized fluid and drained of the pressurized fluid to cause the piston portion to displace within the tube, thereby changing an effective length of the cylinders. The flow rate of fluid into and out of the pressure chambers may relate to a speed of cylinders, while a pressure differential between the two pressure chambers may relate to a force imparted by cylinders on the associated linkage members. The expansion and retraction of the cylinders 60 and 82 may function to assist in repositioning the counterweight attachment and removal system 44, as will be described below.

Figure 5:
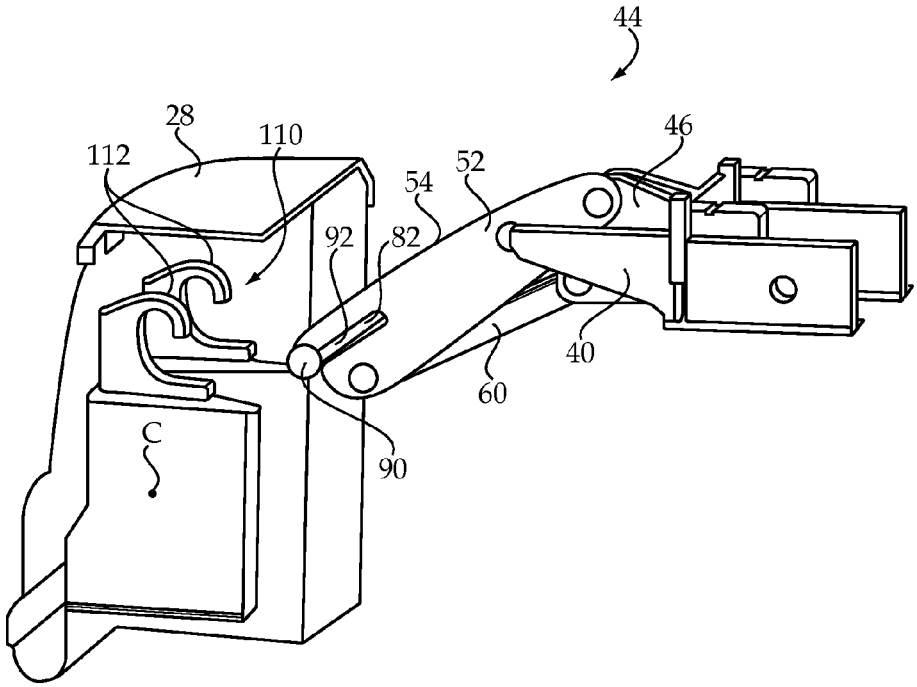
FIG. 5 is the counterweight attachment and removal system of FIGS. 2-4 at a first stage of a counterweight attachment operation, according to another aspect of the present disclosure.

FIG. 5 depicts the counterweight attachment and removal system 44 (with machine 10 removed) in a first configuration, and at a first stage of a load, or attachment, operation. According to the first configuration, the link 52 is pivoted away from the machine mounting bracket 46, the rotate cylinder 60 is retracted, the slide cylinder 82 is extended, and the lift pin 90 is positioned through the distal portions 104 of the slots 92. The counterweight 28 includes a recessed area 110 housing lift hooks 112 that may be supported on the opposing ends 94 and 96 of the lift pin 90. From the first configuration, the counterweight 28 may be loaded onto the machine 10 by engaging the lift hooks 112 of the counterweight 28 with the lift pin 90. Specifically, for example, the rotate cylinder 60 may be extended or retracted to position the lift pin 90 at the appropriate height, and the machine 10 may be moved relative to the counterweight 28 to position the lift pin 90 under the lift hooks 112.

Figure 6:
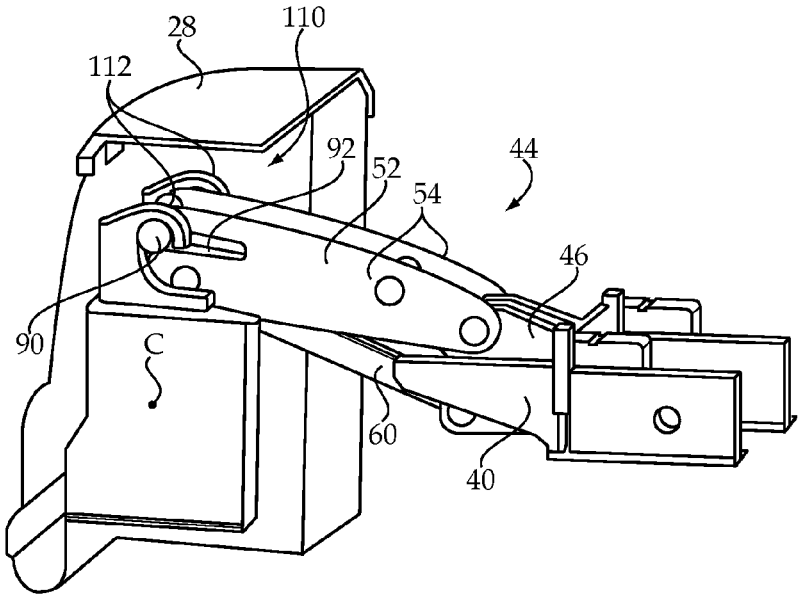
FIG. 6 is the counterweight attachment and removal system of FIGS. 2-4 at a second stage of a counterweight attachment operation, according to another aspect of the present disclosure.
Figure 7:
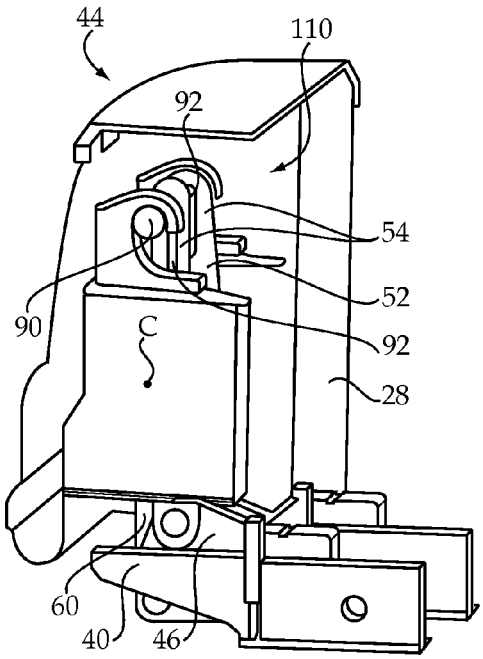
FIG. 7 is the counterweight attachment and removal system of FIGS. 2-4 at a third stage of a counterweight attachment operation, according to another aspect of the present disclosure.

The link 52 may then be pivoted toward the machine 10, as shown in a second stage of the load operation in FIG. 6. Preferably, the counterweight 28 is supported at a position vertically aligned with a center of gravity C of the counterweight 28 to stabilize movement of the counterweight 28. The link 52 may be pivoted by the rotate cylinder 60 until the rotate cylinder 60 is fully extended, as shown in the additional operation stage of FIG. 7. When the rotate cylinder 60 is fully extended, the counterweight 28 may be positioned above, or vertically aligned with, the pair of support platforms 40. The slide cylinder 82 may then be retracted to lower the counterweight 28, along an axis defined by the link 52, onto the support platforms 40. While the slide cylinder 82 is being retracted, the lift pin 90 is being moved from the distal portions 104 of the slots 92 to the proximal portions 102 of the slots 92.

It should be appreciated that "refracted" and "extended," as used herein, may refer to cylinder positions that are fully refracted or extended, or may refer to cylinder positions that are substantially, but not fully, refracted or extended. For example, it may be desirable to only substantially retract the slide cylinder 82 such that, when the counterweight 28 is loaded, or attached, to the machine 10, it may be supported by the support platforms 40 rather than the slide cylinder 82 and other components of the counterweight attachment and removal system 44. Similarly, it may be desirable to only substantially retract or extend the rotate cylinder 60, rather than fully retracting or extending the cylinder 60.

Figure 8:
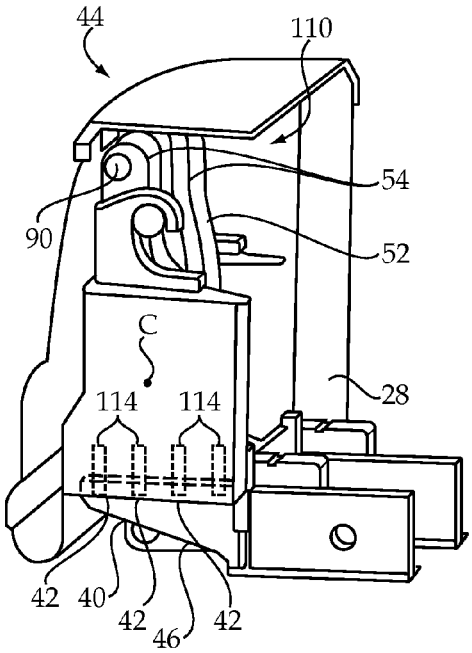
FIG. 8 is the counterweight attachment and removal system of FIGS. 2-4 at a fourth stage of a counterweight attachment operation, according to another aspect of the present disclosure.

At a fourth stage of the load, or attachment, operation, depicted in FIG. 8, the counterweight attachment and removal system 44 is shown in a second configuration. According to the second configuration, the link 52 is pivoted toward the machine 10, the rotate cylinder 60 is extended, the slide cylinder 82 is refracted, and the lift pin 90 is positioned through the proximal portions 102 of the slots 92. Further, according to the second configuration, the counterweight 28 is supported on the pair of support platforms 40, and the link 52, rotate cylinder 60, slide cylinder 82, and lift pin 90 are positioned entirely, or almost entirely, within the recessed area 110 of the counterweight 28. Further, it may be desirable to secure the loaded, or attached, position of the counterweight 28 by threading bolts, or other fasteners, through threaded fastener bores 42 of the support platforms 40 and corresponding threaded fastener bores 114 of the counterweight 28 (FIG. 4). Alternative means for securing the loaded configuration of the counterweight 28 are also contemplated.

To unload, or remove, the counterweight 28 from the machine 10, a reverse operation from that described above may be performed. Specifically, the lift pin 90 may be moved from the proximal portions 102 of the slots 92 to the distal portions 104 of the slots 92 by extending the slide cylinder 82. The link 52 may then be pivoted away from the machine 10 by retracting the rotate cylinder 60. It should be appreciated that the rotate cylinder 60 may be retracted to varying lengths, thus providing multiple unloading positions. For example, the rotate cylinder 60 may be fully, or substantially, retracted to unload the counterweight 28 to the ground. However, the rotate cylinder 60 may be only partially retracted to unload the counterweight 28 to a trailer or other platform. Once the counterweight 28 is supported on the ground or other desired surface, the lift pin 90 may be disengaged from the lift hooks 112 of the counterweight 28.

Figure 9:
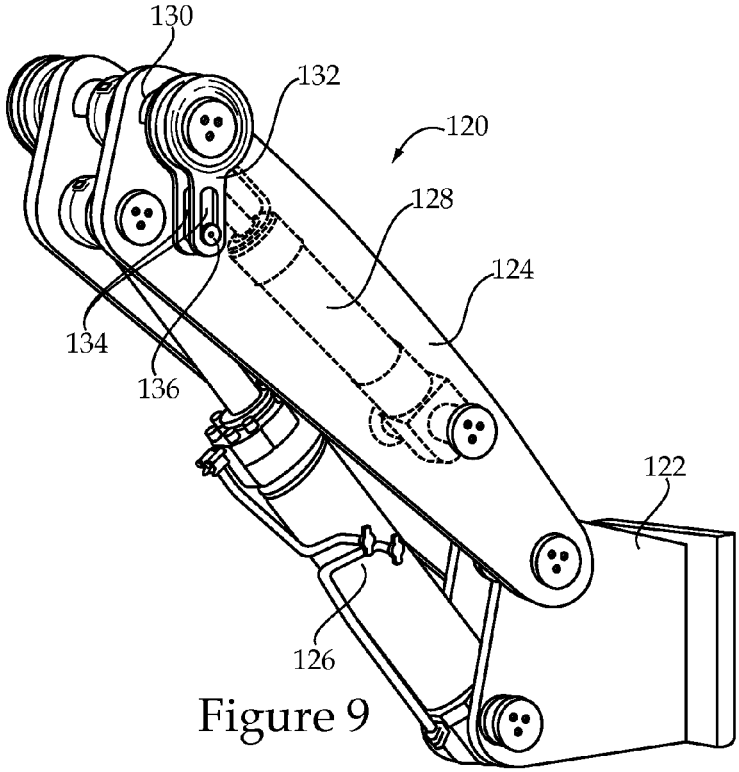
FIG. 9 is a perspective view of an alternative embodiment of a counterweight attachment and removal system, according to another aspect of the present disclosure.
Figure 10:
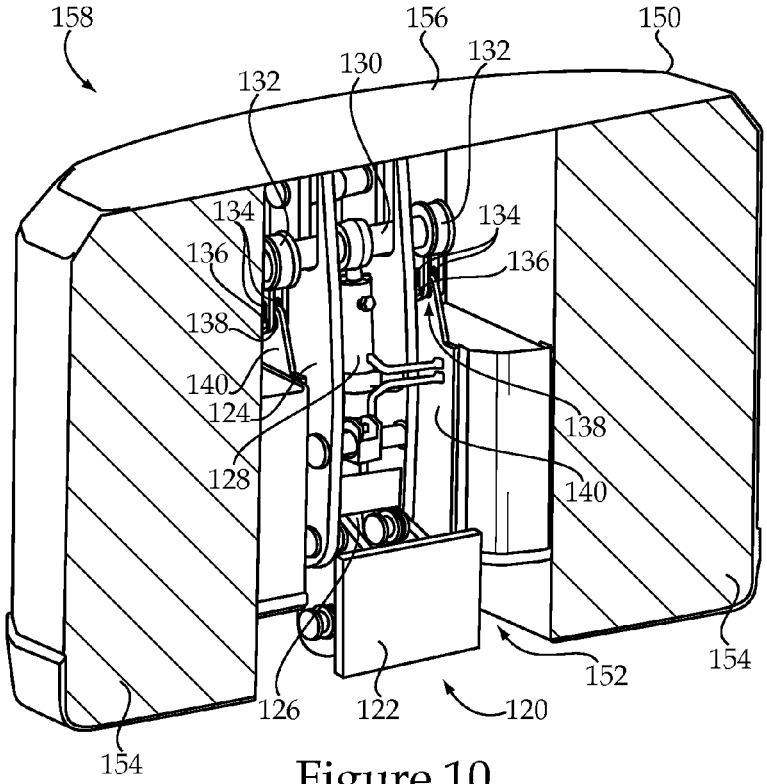
FIG. 10 is a perspective view of an alternative embodiment of a counterweight, which may be used with the counterweight attachment and removal system of FIG. 9, according to another aspect of the present disclosure.

Turning now to FIG. 9, an alternative embodiment of a counterweight attachment and removal system according to the present disclosure is shown at 120. The counterweight attachment and removal system 120 of FIG. 9 is similar to the embodiment of FIGS. 2-8 and generally includes a machine mounting bracket 122, a link 124, a rotate cylinder 126, a slide cylinder 128, and a lift pin 130. The embodiment of FIG. 9, however, may include a support linkage 132 supported on the lift pin 130. The support linkage 132 may be pivotably coupled with the lift pin 130 and may include slots 134, within which pins 136 may slide. As shown in FIG. 10, the pins 136 may be positioned through the linkage slots 134 and corresponding slots or holes 138 through plates 140 of a counterweight 150, shown in FIG. 10. The counterweight 150 also depicts the counterweight attachment and removal system 120 positioned entirely within a recessed area 152. As shown, the recessed area may be defined by sides 154, top 156, and front 158 of the counterweight 150.

Industrial Applicability

The present disclosure may be applicable to machines, such as work machines, utilizing a counterweight to counterbalance a load of the machine. Further, the present disclosure may be applicable to machines utilizing counterweights that must be unloaded from the machines, such as for separate transport or maintenance, and then loaded back onto the machines. Yet further, the present disclosure may be applicable to a counterweight attachment and removal system that has minimal components, occupies a limited amount of space on the machine, and requires minimal operator assistance.

Referring generally to FIGS. 1-10, but more specifically to the counterweight attachment and removal system embodiment of FIGS. 2-8, a machine 10, such as hydraulic excavator, may include an upper frame 16 rotatably supported on a lower frame 12. The upper frame 16 may support an implement system 22 at a front end 20 thereof, and may include a counterweight 28 supported at a back end 30 thereof. The counterweight 28, as should be appreciated, may be attached to the back end 30 of the machine 10 to counterbalance the weight of the implement system 22 mounted on the front end 20 of the machine 10. The weight of the counterweight 28 varies from a few hundred pounds on small machines to several tons on larger machines, and adds significantly to the total weight of the machine 10. There may be times when the counterweight 28 must be removed from the machine 10. For example, when the machine 10 is to be transported from one job site to another, it may be necessary to remove the counterweight 28 from the machine 10 and transport the counterweight 28 separately from the machine 10 to comply with regulations regarding vehicle loads. According to another example, it may be necessary to remove the counterweight 28 from the machine 10 to access components on the machine 10 that may be blocked by the counterweight 28.

The counterweight attachment and removal system 44 disclosed herein may be supported on the rear end 30 of the machine 10 and may be used to load, or attach, the counterweight 28 onto the machine 10, and unload, or remove, the counterweight 28 from the machine 10. The back end 30 of the machine 10 may include a pair of support platforms 40 supported on the upper frame 16 for supporting the counterweight 28. The counterweight attachment and removal system 44 generally includes a machine mounting bracket 46 positioned between the two support platforms 40. A proximal end 56 of a link 52, which includes two spaced apart arms 54, is pivotably coupled with the machine mounting bracket 46. A rotate cylinder 60 has a proximal end 62 pivotably coupled with the machine mounting bracket 46 and a distal end 66 pivotably coupled with a distal end 68 of the link 52. A slide cylinder 82 has a proximal end 84 pivotably coupled with the link 52 and a distal end 88 pivotably coupled with a lift pin 90. The lift pin 90 is positioned through slots 92 defined by the two spaced apart arms 54, with opposing ends 94 and 96 of the lift pin 90 supporting the counterweight 28.

The counterweight 28 may be loaded onto the machine 10 by moving the counterweight attachment and removal system 44 to a first configuration, such as by using hydraulic controls, which may be positioned at the back end 30 of the machine 10, in the operator control station 26, or at another desired location. In the first configuration, the link 52 may be pivoted away from the machine 10 by retracting the rotate cylinder 60. The lift pin 90 may be positioned through distal portions 104 of the slots 92 by extending the slide cylinder 82. Next the lift hooks 112 of the counterweight 28 may be engaged with the lift pin 90. Alternatively, according to the embodiment of FIG. 9, pins 136 may be positioned through the holes 138 of counterweight plates 140 and slots 134 of the linkage 132. The link 52 may then be pivoted toward the machine 10 by extending the rotate cylinder 60. The lift pin 90 may next be moved from the distal portions 104 of the slots 92 to the proximal portions 102 of the slots 92 by retracting the slide cylinder 82.

To unload the counterweight 28 from the machine 10, a reverse operation may be performed. The reverse operation may be controlled using hydraulic controls positioned at a convenient location on the machine 10. Specifically, the lift pin 90 may be moved from the proximal portions 102 of the slots 92 to the distal portions 104 of the slots 92 by extending the slide cylinder 82. The link 52 may then be pivoted away from the machine 10 by retracting the rotate cylinder 60. When the counterweight 28 is moved to the desired supporting surface, such as, for example, the ground or a trailer, the lift pin 90 may be disengaged from the lift hooks 112 of the counterweight 28. According to the alternative embodiment of FIG. 9, the counterweight 150 may be disengaged from the counterweight attachment and removal system 120 by removing the pins 136.

The counterweight attachment and removal system disclosed herein may be provided on new machines or may be provided as a retrofit on current machines, and is an effective system for loading and unloading a counterweight relative to a machine. The counterweight attachment and removal system requires the use of a counterweight having structures, such as, for example, hooks or openings, configured to engage corresponding structures of the counterweight attachment and removal system, such as, for example, a lift pin or linkage. The counterweight attachment and removal system, which requires minimal operator assistance, comprises a relatively minimal number of components and occupies a relatively limited amount of space on the machine. Further, the counterweight attachment and removal system may be stowed entirely within a recessed area of the counterweight when the counterweight is loaded on the machine.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A counterweight attachment and removal system, comprising:

a machine mounting bracket;

a link having two spaced apart arms, wherein a proximal end of the link is pivotably coupled with the machine mounting bracket;

a rotate cylinder having a proximal end pivotably coupled with the machine mounting bracket and a distal end pivotably coupled with a distal end of the link; and a slide cylinder having a proximal end pivotably coupled with the link and a distal end pivotably coupled with a lift pin;

wherein the lift pin is positioned through slots defined by the two spaced apart arms;

wherein the counterweight attachment and removal system includes a first configuration in which the link is pivoted away from the machine mounting bracket, the rotate cylinder is retracted, the slide cylinder is extended, and the lift pin is positioned through distal portions of the slots;

wherein the counterweight attachment and removal system includes a second configuration in which the link is pivoted toward the machine mounting bracket, the rotate cylinder is extended, the slide cylinder is retracted, and the lift pin is positioned through proximal portions of the slots.

2. The counterweight attachment and removal system of claim 1, wherein the counterweight attachment and removal system includes exactly two cylinders.

3. The counterweight attachment and removal system of claim 2, wherein the rotate cylinder and the slide cylinder are positioned between two planes defined by the two spaced apart arms.

4. The counterweight attachment and removal system of claim 3, wherein the proximal end of the link is pivotably coupled with the machine mounting bracket at a first mounting location and the proximal end of the rotate cylinder is pivotably coupled with the machine mounting bracket at a second mounting location that is lower relative to the machine mounting bracket than the first mounting location.

5. The counterweight attachment and removal system of claim 2, wherein opposing ends of the lift pin define counterweight engagement surfaces.

6. A method of operating a machine having a counterweight attachment and removal system, the counterweight attachment and removal system including a machine mounting bracket, a link having two spaced apart arms, wherein a proximal end of the link is pivotably coupled with the machine mounting bracket, a rotate cylinder having a proximal end pivotably coupled with the machine mounting bracket and a distal end pivotably coupled with a distal end of the link, and a slide cylinder having a proximal end pivotably coupled with the link and a distal end pivotably coupled with a lift pin, wherein the lift pin is positioned through slots defined by the two spaced apart arms, the method comprising:

loading a counterweight onto the machine by:

pivoting the link away from the machine;

positioning the lift pin through distal portions of the slots;

engaging lift hooks of the counterweight with the lift pin;

pivoting the link toward the machine; and moving the lift pin from the distal portions of the slots to proximal portions of the slots.

7. The method of claim 6, wherein the first pivoting step includes retracting the rotate cylinder.

8. The method of claim 7, wherein the positioning step includes extending the slide cylinder.

9. The method of claim 8, wherein the second pivoting step includes extending the rotate cylinder.

10. The method of claim 9, wherein the moving step includes retracting the slide cylinder.

11. The method of claim 6, further including unloading the counterweight from the machine by:

moving the lift pin from the proximal portions of the slots to the distal portions of the slots;

pivoting the link away from the machine; and disengaging the lift pin from the lift hooks of the counterweight.

12. The method of claim 6, further including supporting the counterweight at a position vertically aligned with a center of gravity of the counterweight.

13. A machine, comprising:

a frame;

a pair of support platforms supported on the frame;

a counterweight attachment and removal system including:

a machine mounting bracket supported on the frame;

a link having two spaced apart arms, wherein a proximal end of the link is pivotably coupled with the machine mounting bracket;

a rotate cylinder having a proximal end pivotably coupled with the machine mounting bracket and a distal end pivotably coupled with a distal end of the link; and a slide cylinder having a proximal end pivotably coupled with the link and a distal end pivotably coupled with a lift pin;

wherein the lift pin is positioned through slots defined by the two spaced apart arms;

wherein the counterweight attachment and removal system includes a first configuration in which the link is pivoted away from the machine, the rotate cylinder is retracted, the slide cylinder is extended, and the lift pin is positioned through distal portions of the slots;

wherein the counterweight attachment and removal system includes a second configuration in which the link is pivoted toward the machine, the rotate cylinder is extended, the slide cylinder is refracted, and the lift pin is positioned through proximal portions of the slots.

14. The machine of 13, wherein the rotate cylinder and the slide cylinder are positioned between two planes defined by the two spaced apart arms.

15. The machine of claim 14, wherein the machine mounting bracket is positioned between the pair of support platforms.

16. The machine of claim 15, further including a counterweight supported on opposing ends of the lift pin.

17. The machine of claim 16, wherein the counterweight includes a recessed area housing hooks supported on the opposing ends of the lift pin.

18. The machine of claim 17, wherein in the second configuration of the counterweight attachment and removal system the counterweight is supported on the pair of support platforms and the link, rotate cylinder, slide cylinder, and lift pin are positioned entirely within the recessed area of the counterweight.

19. The machine of claim 18, further including vertically aligned fastener bores through the pair of support platforms positioned to align with vertically aligned fastener bores through a bottom of the counterweight in the second configuration of the counterweight attachment and removal system.

20. The machine of claim 13, wherein the frame includes a lower frame and an upper frame rotatably supported on the lower frame.

* * * * *